US008360730B2

(12) United States Patent
Chen et al.

(10) Patent No.: US 8,360,730 B2
(45) Date of Patent: Jan. 29, 2013

(54) TURBINE WHEEL WITH BACKSWEPT INDUCER

(75) Inventors: Hua Chen, Lancashire (GB); William Connor, Manchester (GB)

(73) Assignee: Honeywell International Inc., Morristown, NJ (US)

( * ) Notice: Subject to any disclaimer, the term of this patent is extended or adjusted under 35 U.S.C. 154(b) by 1357 days.

(21) Appl. No.: 11/793,613

(22) PCT Filed: Dec. 21, 2004

(86) PCT No.: PCT/GB2004/005361

§ 371 (c)(1),
(2), (4) Date: Feb. 19, 2008

(87) PCT Pub. No.: WO2006/067359

PCT Pub. Date: Jun. 29, 2006

(65) Prior Publication Data

US 2009/0047134 A1 Feb. 19, 2009

(51) Int. Cl.
*F01D 5/14* (2006.01)
*F01D 5/22* (2006.01)

(52) U.S. Cl. ..... 416/188; 416/185; 416/223 R

(58) Field of Classification Search ..... 416/185, 416/186 R, 228, 238, 223 B
See application file for complete search history.

(56) References Cited

U.S. PATENT DOCUMENTS

| | | | | |
|---|---|---|---|---|
| 4,243,357 | A * | 1/1981 | Flynn et al. | 415/218.1 |
| 4,652,212 | A * | 3/1987 | Burger et al. | 416/188 |
| 7,476,082 | B2 * | 1/2009 | Vogiatzis et al. | 416/188 |
| 2004/0223840 | A1 * | 11/2004 | Vogiatzis et al. | 415/1 |

FOREIGN PATENT DOCUMENTS

| | | | |
|---|---|---|---|
| DE | 10217470 | A1 | 6/2003 |
| JP | 11190201 | A * | 7/1999 |

OTHER PUBLICATIONS

A Parametric Study of the Cavitation Inception Behavior of a Mixed-Flow Pump Impeller Using a Three-Dimensional Potential Flow Model. (The 1997 ASME Fluids Engineering Division Summer Meeting).
PCT ISR/WO (Honeywell).

* cited by examiner

*Primary Examiner* — Ninh H Nguyen
*Assistant Examiner* — Joshua R Beebe
(74) *Attorney, Agent, or Firm* — Brian J. Pangrle

(57) ABSTRACT

An exemplary blade (220) for a turbine wheel includes an exducer portion with a trailing edge and an inducer portion with a leading edge wherein the inducer portion has a positive local blade angle at the leading edge with respect to the intended direction of rotation of the turbine wheel. An exemplary turbine wheel (200) includes a plurality of such exemplary blades. Various other exemplary turbine-related technologies are also disclosed.

11 Claims, 7 Drawing Sheets

EXEMPLARY TURBINE BLADE
220

TURBINE WHEEL WITH BACKSWEPT INDUCER

TECHNICAL FIELD

Subject matter disclosed herein relates generally to a backswept inducer for turbomachinery.

BACKGROUND

Turbine performance depends on available energy content per unit of drive gas and the blade tangential velocity, U, wherein the available energy for the turbine pressure ratio may be expressed as an ideal velocity, C. The turbine velocity ratio or blade-jet-speed ratio, U/C, may be used to empirically characterize the available energy and blade tangential velocity with respect to turbine efficiency. The blade-jet-speed ratio may also be defined as the ratio of circumferential speed and the jet velocity corresponding to an ideal expansion from inlet total to exit total conditions.

Turbochargers often operate at conditions with low blade-jet-speed ratio values (e.g., U/C<0.7). Radially stacked turbine rotors typically have an optimum U/C value of 0.7 where they achieve their highest efficiency. This rotor characteristic reduces the efficiency of the turbines at low blade-jet-speed ratio conditions. Further, the inducer of a radially stacked turbine rotor has a blade (metal) angle of zero degrees at its leading edge, which leads to positive incidence (flow angle minus blade angle) in the inducer when the U/C value drops below 0.7. The positive incidence can cause flow separation in the rotor with reduction in turbine efficiency.

A need exists for blades that reduce positive incidence at low U/C values. Various exemplary methods, devices, systems, etc., disclosed herein aim to meet this need and/or other needs.

BRIEF DESCRIPTION OF THE DRAWINGS

A more complete understanding of the various methods, devices, systems, etc., described herein, and equivalents thereof, may be had by reference to the following detailed description when taken in conjunction with the accompanying drawings wherein.

DETAILED DESCRIPTION

Various exemplary methods, devices, systems, etc., disclosed herein address issues related to turbine efficiency. For example, as described in more detail below, exemplary technology addresses reduction of positive incidence at low U/C values.

Figure 1:
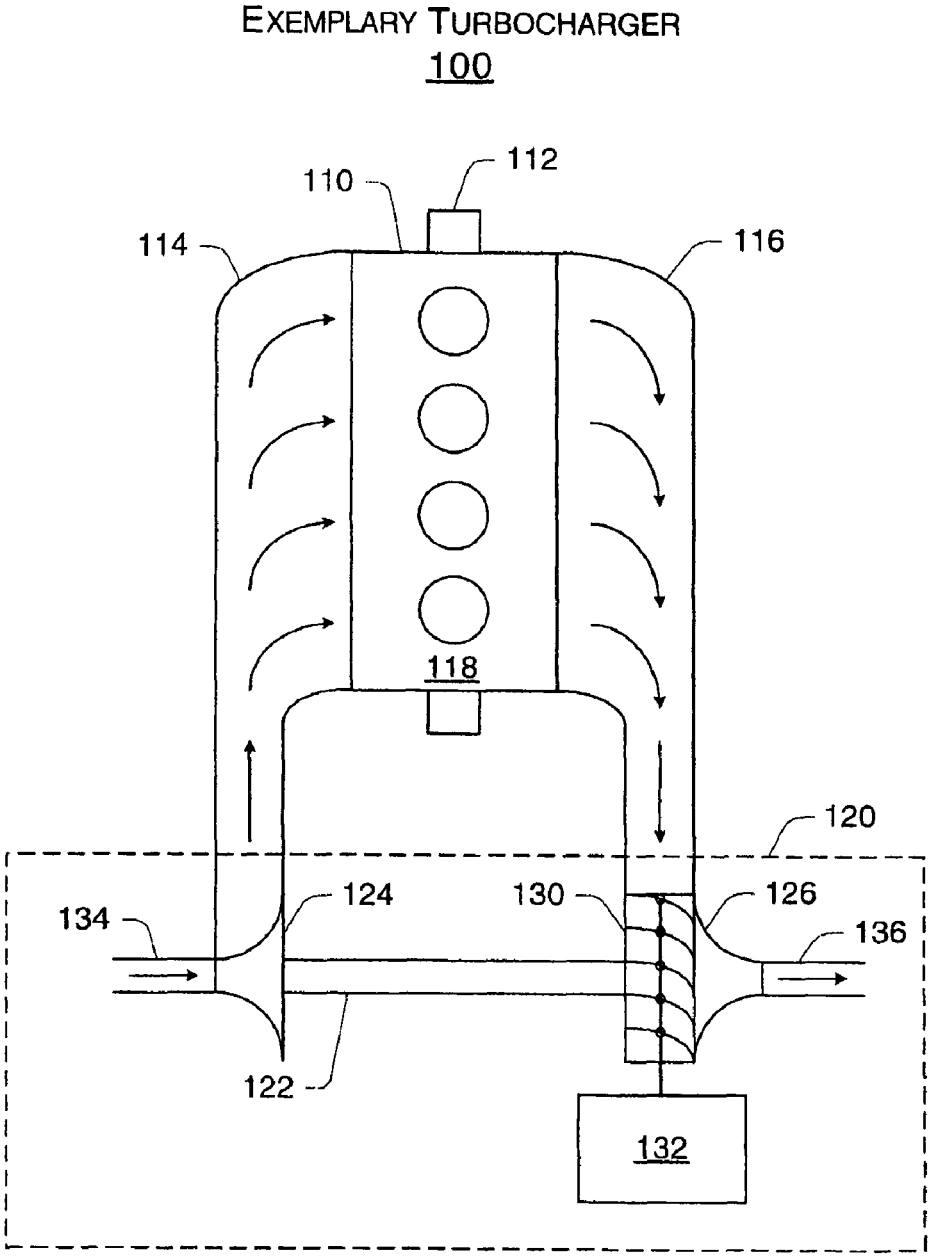
Fig.1 (Prior Art)
FIG. 1 is a simplified approximate diagram illustrating a turbocharger with a variable geometry mechanism and an internal combustion engine.

Turbochargers are frequently utilized to increase the output of an internal combustion engine. Referring to FIG. 1, an exemplary system 100, including an exemplary internal combustion engine 110 and an exemplary turbocharger 120, is shown. The internal combustion engine 110 includes an engine block 118 housing one or more combustion chambers that operatively drive a shaft 112. As shown in FIG. 1, an intake port 114 provides a flow path for air to the engine block while an exhaust port 116 provides a flow path for exhaust from the engine block 118.

The exemplary turbocharger 120 acts to extract energy from the exhaust and to provide energy to intake air, which may be combined with fuel to form combustion gas. As shown in FIG. 1, the turbocharger 120 includes an air inlet 134, a shaft 122, a compressor 124, a turbine 126, a variable geometry unit 130, a variable geometry controller 132 and an exhaust outlet 136. The variable geometry unit 130 optionally has features such as those associated with commercially available variable geometry turbochargers (VGTs), such as, but not limited to, the GARRETT® VNT™ and AVNT™ turbochargers, which use multiple adjustable vanes to control the flow of exhaust across a turbine.

Adjustable vanes positioned at an inlet to a turbine typically operate to control flow of exhaust to the turbine. For example, GARRETT® VNT™ turbochargers adjust the exhaust flow at the inlet of a turbine in order to optimize turbine power with the required load. Movement of vanes towards a closed position typically increases the pressure differential across the turbine and directs exhaust flow more tangentially to the turbine, which, in turn, imparts more energy to the turbine and, consequently, increases compressor boost. Conversely, movement of vanes towards an open position typically decreases the pressure differential across the turbine and directs exhaust flow in more radially to the turbine, which, in turn, reduces energy to the turbine and, consequently, decreases compressor boost. Thus, at low engine speed and small exhaust gas flow, a VGT turbocharger may increase turbine power and boost pressure; whereas, at full engine speed/load and high gas flow, a VGT turbocharger may help avoid turbocharger overspeed and help maintain a suitable or a required boost pressure.

A variety of control schemes exist for controlling geometry, for example, an actuator tied to compressor pressure may control geometry and/or an engine management system may control geometry using a vacuum actuator. Overall, a VGT may allow for boost pressure regulation which may effectively optimize power output, fuel efficiency, emissions, response, wear, etc. Of course, an exemplary turbocharger may employ wastegate technology as an alternative or in addition to aforementioned variable geometry technologies. In yet other examples, a turbine does not include variable geometry technology.

As mentioned in the Background section, the inducer of a radially stacked turbine rotor has a blade (metal) angle of zero degrees near its leading edge, which leads to positive incidence (flow angle minus blade angle) in the inducer when the U/C value drops below 0.7. The positive incidence can cause flow separation in the rotor with reduction in turbine efficiency. According to various exemplary methods, devices, systems, etc., disclosed herein, a turbine wheel blade includes a backswept inducer with a positive blade angle near the leading edge (i.e., on an approach to the leading edge). Such an exemplary blade reduces positive incidence when a turbine operates at U/C values less than about 0.7.

Of course, turbines may need to operate at U/C values greater than about 0.7. Under such conditions, the backswept inducer increases the negative incidence; however, turbine wheels can typically tolerate large negative incidences. Thus, turbine efficiency under negative incidence will not be affected by a modest inducer backsweep. Where a turbine operates constantly at U/C values greater than about 0.7, a forward-swept inducer may be used to reduce the negative incidence. While the various figures do not illustrate a forward-swept inducer, such an inducer may be readily understood with respect to the description set forth herein.

Figure 2:
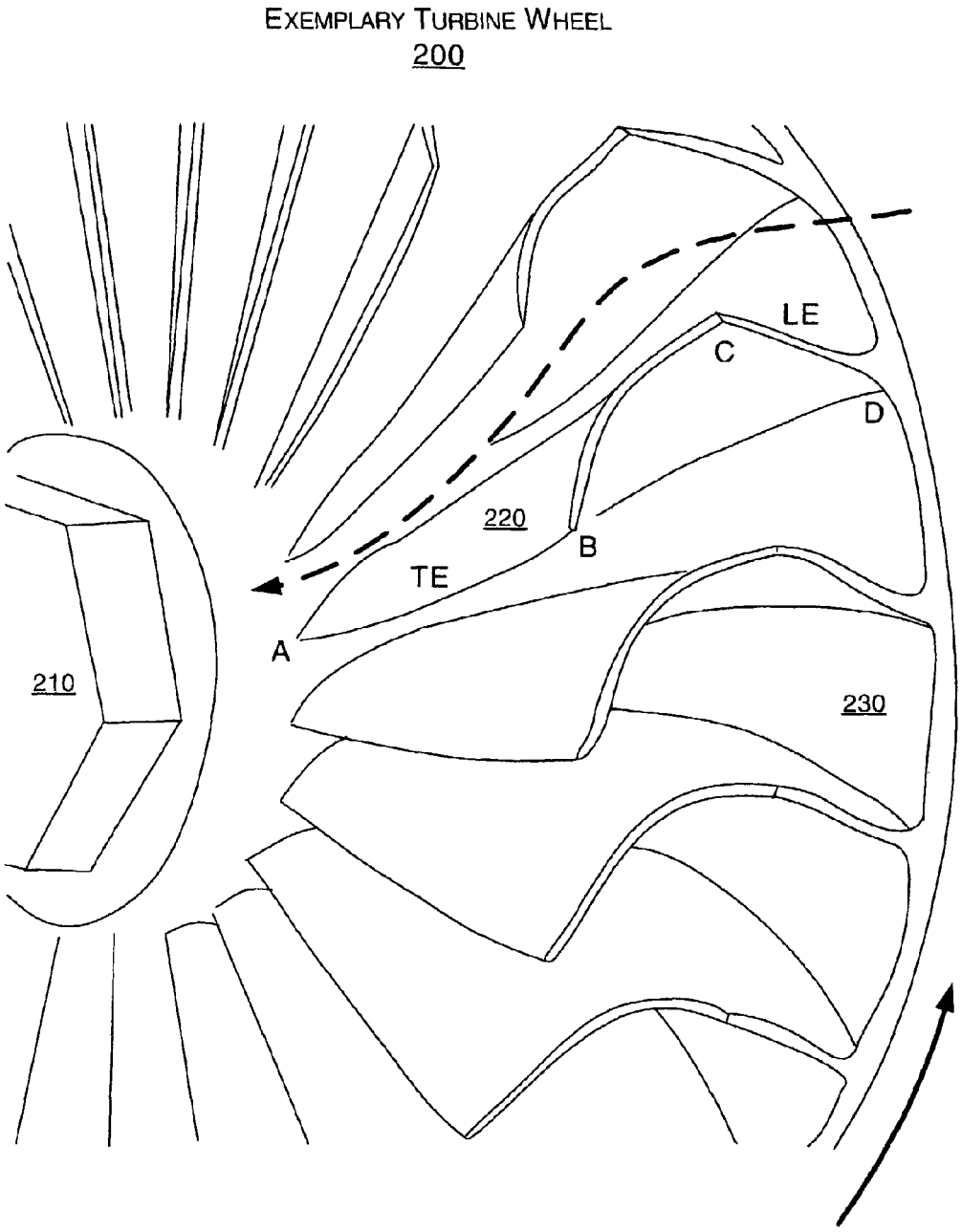
FIG. 2 is a perspective view of a section of an exemplary turbine wheel where each blade includes a backswept inducer.

FIG. 2 shows a perspective view of a section of an exemplary turbine wheel 200. The wheel 200 includes a hub 210, a plurality of blades 220 and a backplate 230. A thick arrow indicates a direction of rotation for the wheel 200 and a thick dashed arrow indicates a direction of flow from a leading edge (LE) to a trailing edge (TE) of the blade 220. The leading edge (LE) corresponds to the inducer and the trailing edge corresponds to the exducer of the turbine wheel 200. The trailing edge (TE) is defined approximately as an edge portion of the blade 220 between points A and B while the leading edge (LE) is defined approximately as an edge portion of the blade 220 between points C and D. The point A indicates where the blade 220 meets the hub 210 and the point D indicates where the blade 220 meets the backplate 230. The point C may be referred to as a shroud end of the leading edge (LE) and the point D may be referred to as a backplate end of the leading edge (LE). In some instances, the backplate 230 may be considered part of a hub; thus, in such instances, the point D may be referred to as a hub end of the leading edge (LE).

In FIG. 2, the exemplary blades 220 include a backswept inducer, where backswept refers to the leading edge being swept back from the direction of rotation. In this example, the backsweep increases as the leading edge approaches the backplate 230 (i.e., point D). In other words, the blade angle near point D is positive and larger than the blade angle near point C, which is, in general, also positive.

Figure 3:
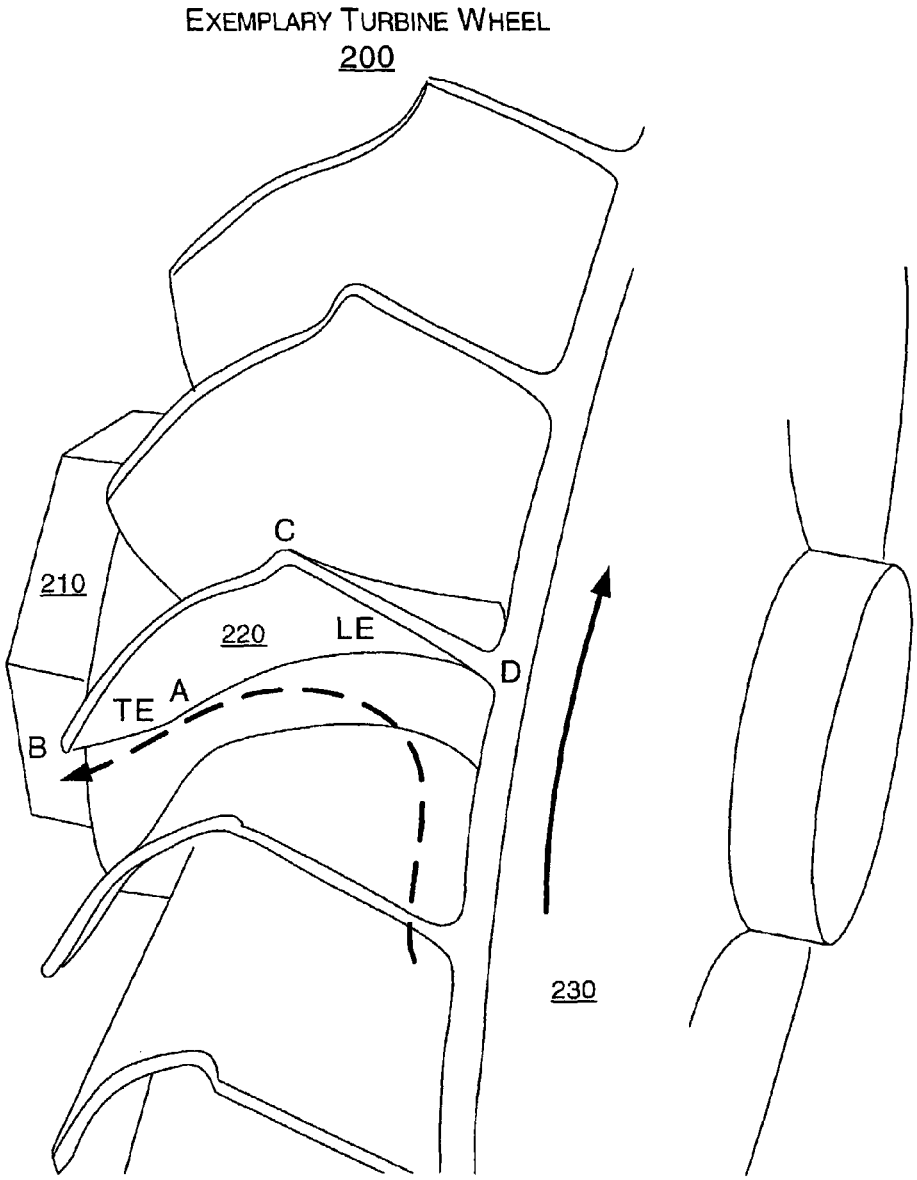
FIG. 3 is a perspective view of a section of an exemplary turbine wheel where each blade includes a backswept inducer.

FIG. 3 shows another perspective view of the exemplary turbine wheel 200. A thick arrow indicates a direction of rotation for the wheel 200 and a thick dashed arrow indicates a direction of flow from a leading edge (LE) to a trailing edge (TE) of the blade 220. Of course, the actual flow channel is bounded by two blades and a portion of the hub 210 and a portion of the backplate 230. A shroud surface of a turbine housing may act to define another boundary for the flow channel. Points A, B, C and D are also shown in FIG. 3, which correspond to the points discussed with respect to FIG. 2.

Figure 4:
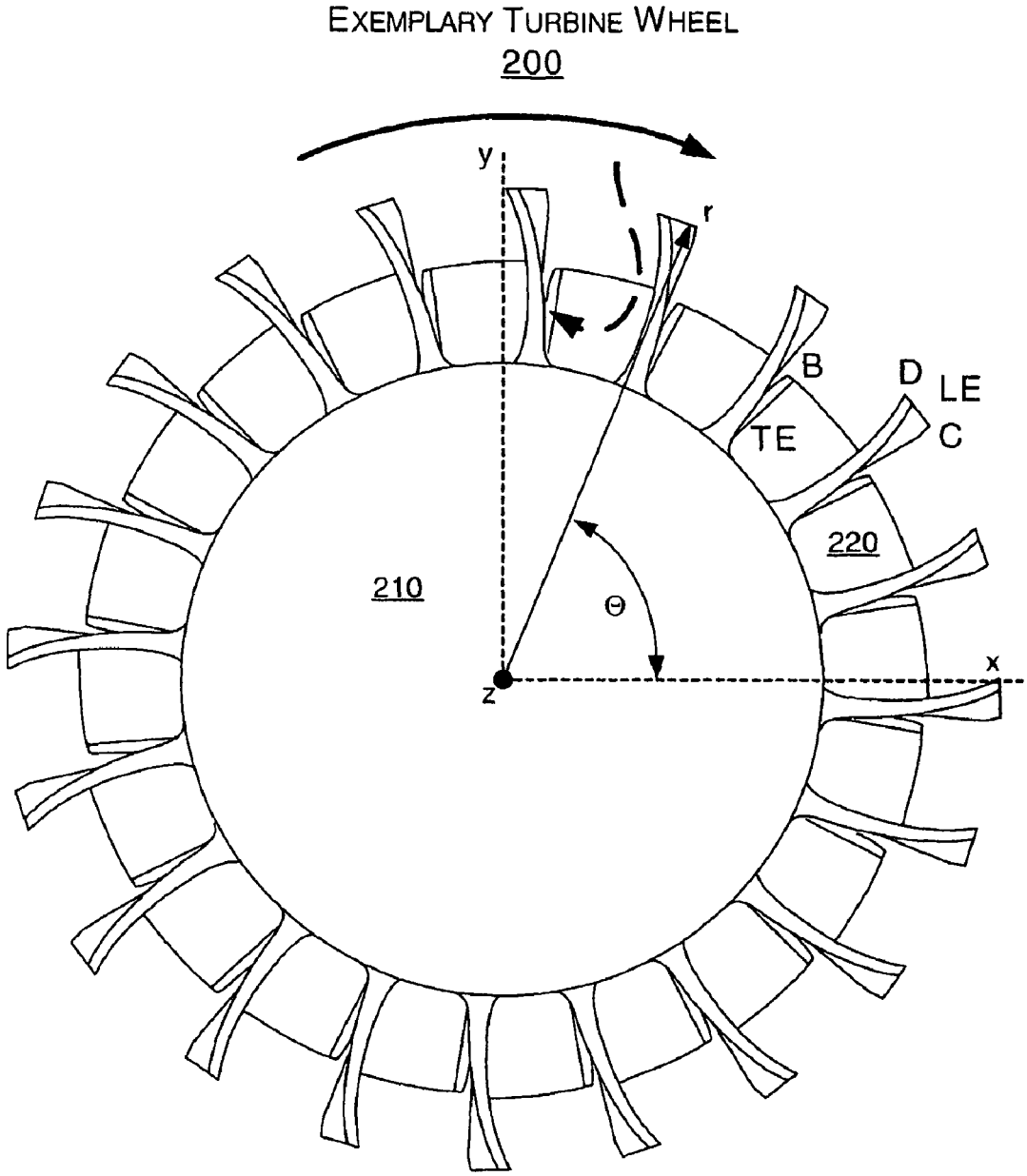
FIG. 4 is a bottom view of an exemplary turbine wheel where the backplate has been removed and where each blade includes a backswept inducer.

FIG. 4 shows a bottom view of the exemplary turbine wheel 200 where the backplate has been removed to expose the hub 210. A thick arrow indicates a direction of rotation for the wheel 200 and a thick dashed arrow indicates a direction of flow from a leading edge (LE) to a trailing edge (TE) of a blade, such as the blade labeled 220. Points B, C and D are also shown in FIG. 4, which correspond to the points discussed with respect to FIG. 2.

FIG. 4 shows a reference coordinate system that may be used to describe a turbine wheel. This system generally follows a system such as the "Kaplan drawing method" described by Stepanoff, "Centrifugal and axial flow pumps," Theory, Design and Application, JOHN WILEY & SONS, INC, New York (1957). A z-axis represents an axis of rotation for the exemplary turbine wheel 200 while an x-axis and a y-axis define a plane perpendicular to the z-axis. A radial distance "r" extends to a point on the wheel 200, such as an edge of a blade, at a particular angle, Θ, which may be referred to as the angular coordinate, polar angle or wrap angle.

Figure 5:
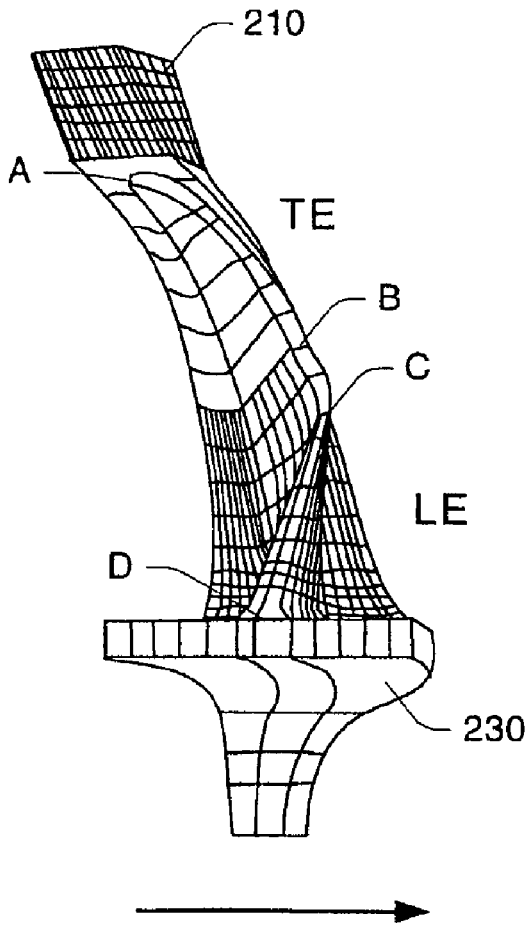
FIG. 5 is a side view of an exemplary turbine wheel blade that includes a backswept inducer.

FIG. 5 shows an exemplary turbine blade 220 suitable for a turbine wheel. The blade 220 extends between a hub portion 210 and a backplate portion 230. The blade 220 has a leading edge (LE) between points C and D and a trailing edge (TE) between points A and B, where the points have been described above with respect to FIG. 2. With respect to the coordinate system of FIG. 4, the blade 220 represents a segment ΔΘ, where a plurality of such segments may form a wheel. Further, any point on the blade 220 may be defined with respect to r, 0 and z. For example, points on the leading edge (LE) have corresponding r, 0 and z coordinate as do points on the trailing edge (TE). A thick arrow indicates a direction of rotation of a wheel with such a blade. Again, the leading edge (LE) of the exemplary blade 220 is swept back with respect to the direction of rotation.

Figure 6:
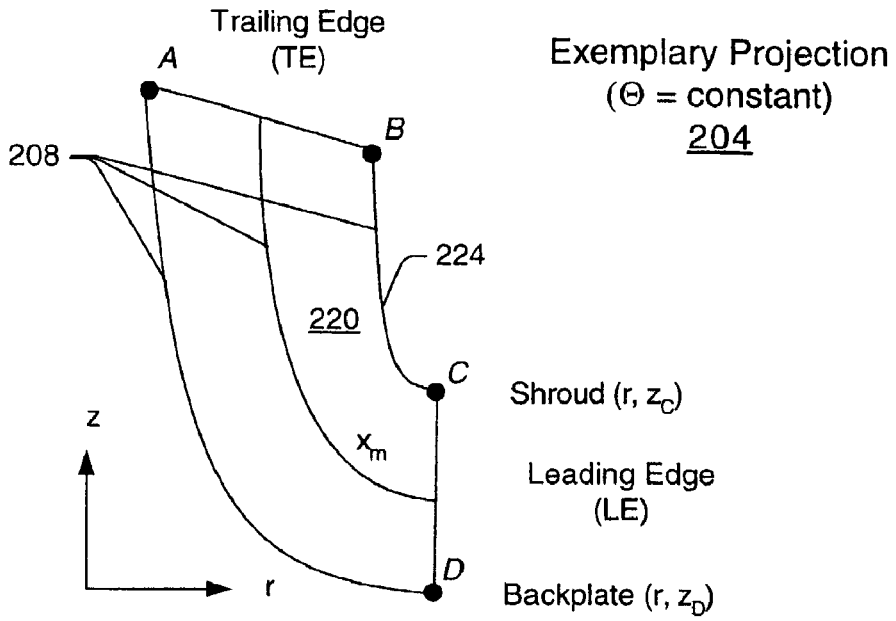
FIG. 6 is a projection of an exemplary turbine wheel blade that includes a backswept inducer.

FIG. 6 shows an exemplary projection 204 of an exemplary blade 220. The projection 204 of the blade 220 to an rz-plane corresponds to a constant Θ. According to the coordinate system of FIG. 4, the projection 204 creates construction lines 208 from the camber lines on the meridional plane. For an exemplary blade 220, the camber lines extend between the leading edge (LE) and the trailing edge (TE); thus, the construction lines 208 extend between the leading edge (LE) and the trailing edge (TE). The position along a construction line is described by a meridional coordinate $x_m$. The curvature of a camber line is described by the local blade angle β, which may be defined by the following equation (Eqn. 1):

$$\tan(\beta)=rd\Theta/dx_m \quad (1).$$

Given Eqn. 1, local blade angle may be described as being near an edge as a construction line described by the meridional coordinate essentially ends at the edge.

An exemplary blade optionally includes an inducer with a modest backsweep. For example, a modest backsweep may correspond to a local blade angle near the leading edge of a blade from about 10 degrees (10°) to about 25 degrees (25°). As already mentioned, blade angle near the leading edge of an exemplary blade may vary. For example, an exemplary blade may include a blade angle proximate to the backplate end of the leading edge that exceeds the blade angle proximate to the shroud end of the leading edge. Thus, the local blade angle may vary as one moves along (and near) the leading edge.

Figure 7:
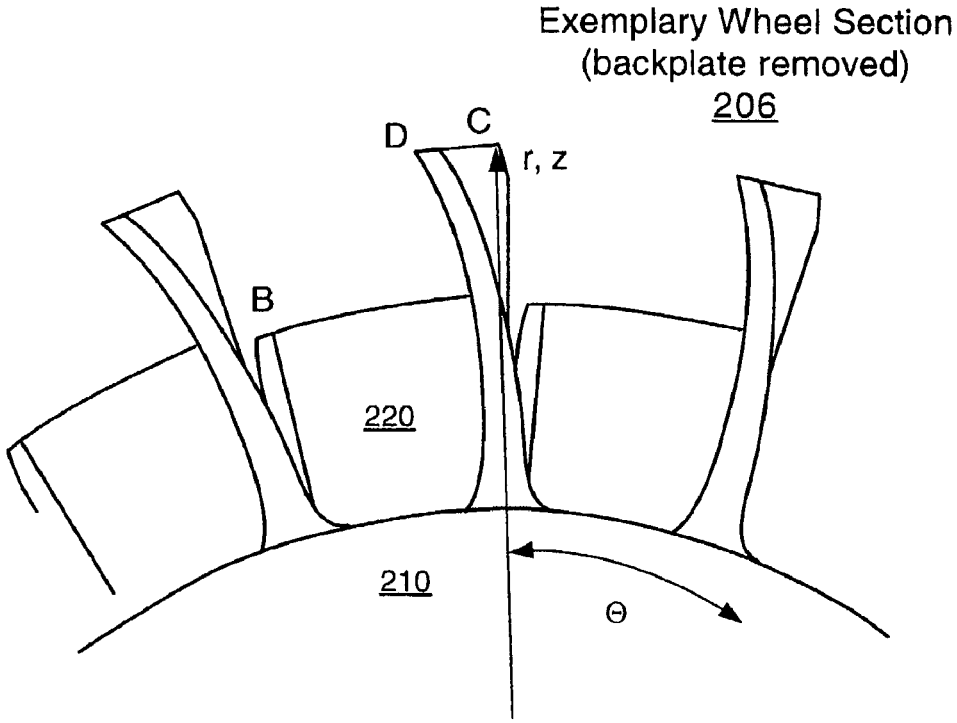
FIG. 7 is an enlarged view of a section of the exemplary turbine wheel of FIG. 4 where the backplate has been removed.

FIG. 7 shows an enlarged section 206 of the exemplary wheel 200 of FIG. 4. This section illustrates three blades 220 and the hub 210 along with points B, C and D and r, z and Θ coordinates. In particular, an arrow indicates the r, z and Θ coordinates of point C. Given the description herein and Eqn. 1, the blade angle β near point C may be determined. Similarly, other local blade angles may be determined for the exemplary blade 220.

Figure 8:
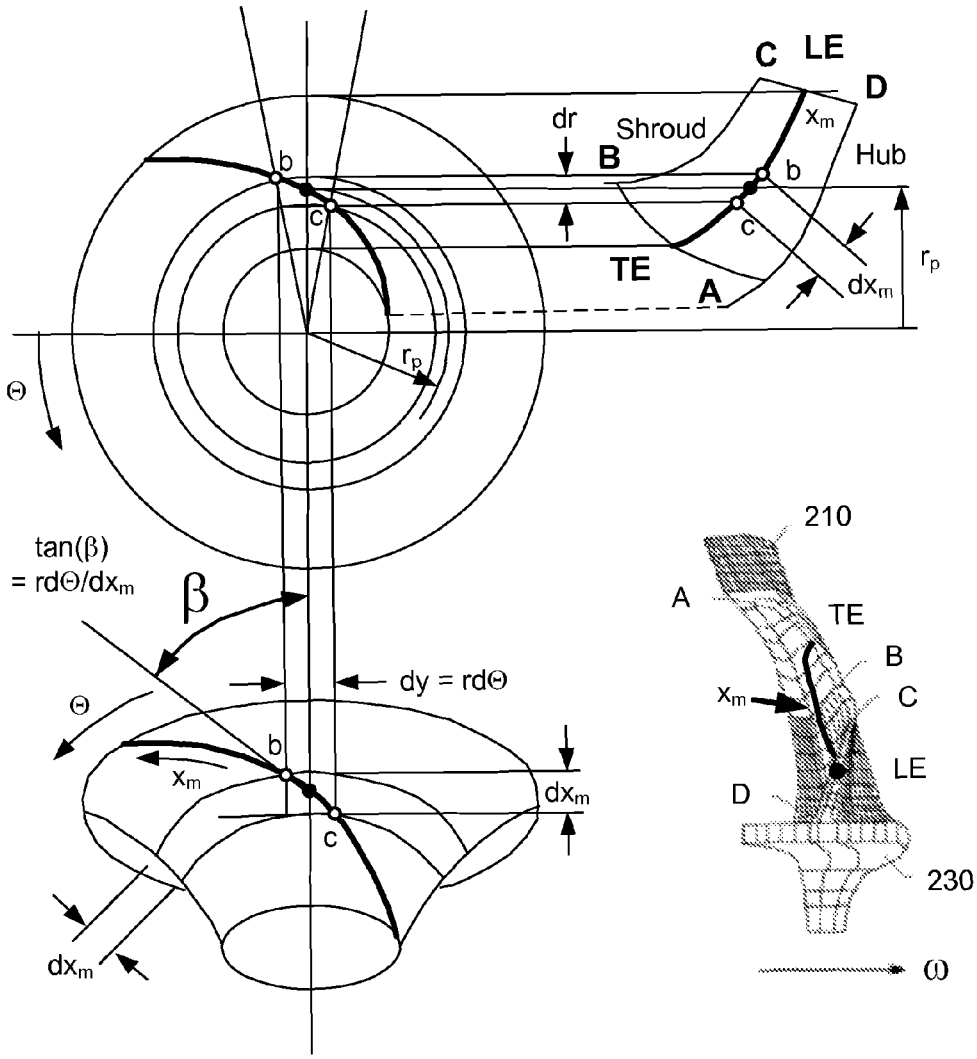
FIG. 8 is a diagram illustrating various parameters of a turbine wheel with respect to a coordinate system.

FIG. 8 shows a diagram illustrating various parameters of a turbine wheel with respect to a coordinated system. Specifically, the blade angle β is illustrated (see also Equation 1, above.) For radial stacking, the local blade angle β approaching the leading edge (LE) is zero (i.e., $d\theta/dx_m=0$); whereas, for non-radial stacking, the local blade angle β approaching the leading edge (LE) may have a positive value or a negative value (i.e., $d\theta/dx_m\neq0$).

A backswept inducer may act to increase mechanical stress of the inducer under centrifugal load. To counteract such increases in mechanical stress, where appropriate, a turbine with backswept inducer blades may operate at a reduced speed compared to a turbine without such blades; a modest backsweep may be used (e.g., about 10° to about 25°); inducer tip width (leading edge width) may be reduced compared to a blade without a backswept inducer; backsweep angle may be small near the shroud end of the leading edge and increase toward the backplate end of the leading edge; and/or inducer blade thickness may be chosen in a manner to account for any increase in stress with respect to a blade that does not include a backswept inducer.

An exemplary method of reducing positive incidence of a turbine wheel blade at U/C values less than about 0.7 includes providing a blade with a backswept inducer where the backswept inducer includes one or more positive local blade angles near the leading edge.

As already mentioned, a forward-swept inducer may be used to reduce negative incidence for turbines that typically operate at U/C values in excess of about 0.7. The description herein allows for an understanding of such exemplary blades. For example, Eqn. 1 and the coordinate system of FIG. 4 can apply to a forward-swept inducer as well as a backward swept inducer.

Although some exemplary methods, devices, systems, etc., have been illustrated in the accompanying Drawings and described in the foregoing Detailed Description, it will be understood that the methods, devices, systems, etc., are not limited to the exemplary embodiments disclosed, but are capable of numerous rearrangements, modifications and substitutions without departing from the spirit set forth and defined by the following claims.

The invention claimed is:

1. A blade comprising:

an exducer portion with a trailing edge; and an inducer portion with a leading edge extending between a backplate end at a backplate of a turbine wheel and a shroud end, wherein the inducer portion has positive local blade angles near the leading edge defined with respect to a meridional direction and an intended direction of rotation of the turbine wheel and wherein, to account for mechanical stress associated with the positive local blade angles, the positive local blade angles decrease in value in a direction from the backplate end to the shroud end.

2. The blade of claim 1 wherein the local blade angles near the leading edge comprise positive local blade angles between approximately 10° and approximately 25°.

3. The blade of claim 1 wherein the turbine wheel operates at a blade-jet-speed ratio, U/C value, less than about 0.7.

4. The blade of claim 1 wherein the backplate end of the leading edge and the shroud end of the leading edge are displaced by a wrap angle.

5. The blade of claim 1 wherein the local blade angle is defined by an equation $\tan(\beta)=rd\Theta/dx_m$ wherein $\beta$ is the local blade angle, $\Theta$ is an angular coordinate defined with respect to a rotational axis of a turbine wheel, and $x_m$ is a meridional coordinate.

6. A turbine wheel having a rotational axis, a backplate and a plurality of blades wherein one or more blades includes an inducer portion with a leading edge extending between a backplate end at the backplate and a shroud end, wherein the inducer portion includes positive local blade angles near the leading edge defined with respect to a meridional direction and an intended direction of rotation of the turbine wheel and wherein, to account for mechanical stress associated with the positive local blade angles, the positive local blade angles decrease in value in a direction from the backplate end to the shroud end.

7. The turbine wheel of claim 6 wherein the backplate end of the leading edge and the shroud end of the leading edge are displaced by a wrap angle

8. The turbine wheel of claim 6 wherein the local blade angle is defined by an equation $\tan(\beta)=rd\Theta/dx_m$ wherein $\beta$ is the local blade angle, $\Theta$ is an angular coordinate defined with respect to the rotational axis, and $x_m$ is a meridional coordinate.

9. A method of reducing positive incidence of a turbine wheel blade at blade-jet-speed ratios, U/C values, less than about 0.7 comprising providing a blade with a backswept inducer, wherein the blade comprises a leading edge extending between a backplate end at a backplate of a turbine wheel and a shroud end that comprises positive local blade angles near the leading edge defined with respect to a meridional direction and an intended direction of rotation of the turbine wheel and wherein, to account for mechanical stress associated with the positive local blade angles, the positive local blade angles decrease in value in a direction from the backplate end to the shroud end.

10. The method of claim 9 wherein the backplate end of the leading edge and the shroud end of the leading edge are displaced by a wrap angle.

11. The method of claim 9 wherein the local blade angle is defined by an equation $\tan(\beta)=rd\Theta/dx_m$ wherein $\beta$ is the local blade angle, $\Theta$ is an angular coordinate defined with respect to a rotational axis of the turbine wheel, and $x_m$ is a meridional coordinate.

* * * * *